US006311937B1

(12) United States Patent
Han

(10) Patent No.: US 6,311,937 B1
(45) Date of Patent: Nov. 6, 2001

(54) GOLF BAG WITH SEATING APPARATUS

(76) Inventor: Don Kyu Han, 1 Saros, Irvine, CA (US) 92612

( * ) Notice: Subject to any disclaimer, the term of this patent is extended or adjusted under 35 U.S.C. 154(b) by 0 days.

(21) Appl. No.: 09/497,560

(22) Filed: Feb. 3, 2000

Related U.S. Application Data

(63) Continuation-in-part of application No. 09/288,910, filed on Apr. 9, 1999.

(51) Int. Cl.[7] ..... A63B 55/00

(52) U.S. Cl. ..... 248/96; 206/315.3; 206/315.7; 280/646

(58) Field of Search ..... 248/95, 96, 97; 206/315.3, 315.7; 280/646, 645

(56) References Cited

U.S. PATENT DOCUMENTS

| | | | | |
|---|---|---|---|---|
| 1,757,471 | | 5/1930 | Platt . | |
| 2,430,107 | | 11/1947 | Cronrath | 214/65 |
| 2,774,403 | * | 12/1956 | Williamson | 206/315.3 |
| 2,777,707 | * | 1/1957 | Cloes | 280/646 |
| 3,735,997 | | 5/1973 | Seibold et al. | 280/36 |
| 3,995,881 | | 12/1976 | Kruchell | 280/646 |
| 4,062,564 | | 12/1977 | Schimmeyer | 280/652 |
| 4,098,478 | | 7/1978 | Spitzke | 248/156 |
| 4,400,006 | | 8/1983 | Larkin | 280/646 |
| 4,403,806 | | 9/1983 | Stephen | 297/217 |
| 4,431,230 | | 2/1984 | Sutton | 297/217 |
| 4,620,682 | | 11/1986 | Yim | 248/96 |
| 4,834,235 | | 5/1989 | Solheim et al. | 206/315.7 |
| 4,921,192 | | 5/1990 | Jones | 248/96 |
| 4,988,117 | | 1/1991 | Shortall | 280/646 |
| 5,152,483 | | 10/1992 | Maeng | 248/96 |
| 5,154,377 | | 10/1992 | Suk | 248/96 |
| 5,186,424 | | 2/1993 | Shultz et al. | 248/179 |
| 5,209,350 | | 5/1993 | Maeng | 206/315.7 |
| 5,236,085 | | 8/1993 | Quellais | 206/315.7 |
| 5,340,063 | | 8/1994 | Hsieh | 248/96 |
| 5,415,285 | | 5/1995 | Reimers | 206/315.7 |
| 5,439,241 | | 8/1995 | Nelson | 280/645 |
| 5,464,180 | | 11/1995 | Cheng | 248/96 |
| 5,470,095 | * | 11/1995 | Bridges | 28/646 |
| 5,505,471 | | 4/1996 | Cheng | 280/30 |
| 5,507,384 | | 4/1996 | Maeng | 206/315.7 |
| 5,516,064 | | 5/1996 | Hsieh | 248/96 |
| 5,549,263 | | 8/1996 | Maeng | 248/96 |
| 5,607,128 | | 3/1997 | Suk | 248/96 |
| 5,632,496 | * | 5/1997 | Nelson | 206/315.3 |
| 5,762,189 | | 6/1998 | Reimers | 206/315.7 |
| 5,799,786 | | 9/1998 | Beck et al. | 206/315.7 |
| 5,836,601 | | 11/1998 | Nelson | 280/645 |
| 5,915,551 | * | 6/1999 | Vavro | 206/315.5 |
| 6,062,383 | | 5/2000 | Han | 206/315.7 |

* cited by examiner

*Primary Examiner*—Ramon O. Ramirez
*Assistant Examiner*—Tan Le
(74) *Attorney, Agent, or Firm*—Lee & Hong

(57) ABSTRACT

A golf bag comprises a body having a front surface, a back surface, a lower region and a base member. The body defines a longitudinal axis; at least one leg pivotally connected to the back surface of the body pivoting between a retracted position where the leg is disposed substantially longitudinally along the back surface of the body and an extended position where lower end of the leg is spaced apart from the body. The golf bag has a pocket member attached to the front lower region of the body. The pocket member has a collapsible seating surface associated with the front surface of the body. The golf bag also has a support structure connected to the base member and disposed in the pocket member. The support structure includes at least one frame member supporting the seating surface, wherein ends of the frame member are extended from the base member of the body to form the seating surface when the body is tilted. The support member includes a first frame member connected to the base member and a second frame member pivotally connected to the base member. The second frame member is at least partially coupled to the body to pivot in accordance with the pivoting movement of the body. Preferably, the first frame member is unpivotally erected from the base member. The seating surface is supported by a substantially rigid support member of sufficient strength to support the weight of a golfer.

28 Claims, 4 Drawing Sheets

GOLF BAG WITH SEATING APPARATUS

CROSS REFERENCE TO RELATED ART

This is a continuation-in-part of application Ser. No. 09/288,910, filed Apr. 9, 1999, which is hereby incorporated by reference in its entirety.

BACKGROUND OF THE INVENTION

1. Field of the Invention

This invention relates to golf bags, and more particularly to golf bags having a support stand and extendable and retractable seating apparatus.

2. Discussion of the Related Art

Golf is one of the most widely played sports activities in the United States. Not only is this activity already widespread, but the number of golfers continue to grow due to popularity of the sport caused by high stake televised games.

The sport of golf is typically played with a set of golf clubs which are commonly placed in a golf bag. When a golf bag is carried by a golfer, it is desirable to include a stand which supports the golf bag in its upright position to allow easy access to the golf clubs. Conventionally, this function has been accommodated by providing legs which are extendable when the golf bag is placed on the ground and retractable when the golf bag is carried.

Various methods have been used to move the legs between their retracted and extended positions. One method is described in U.S. Pat. No. 5,154,377 to Suk (the "Suk reference"). In the Suk reference, before a pair of legs can be used to support a golf bag, a slide member must be moved in a descending position along a two parallel groove track formed in a slide bracket. When the extending feature of the legs are not needed, the user must then manually move the slide member in an upward position along the track. The manual operation of the sliding member may be cumbersome to some golfers.

Another conventional golf bag stand is described in U.S. Pat. No. 5,152,483 to Maeng (the "Maeng reference"). In the Maeng reference, the pair of legs extend away from the golf bag to provide support when the golf bag is forcefully tilted with respect to the ground. In such a position, the contact surface area of the golf bag with the ground is minimal, which comprises the tips of two legs and an edge of the golf bag, and thus possibly causing the golf bag to tip over when it is placed on a slope or irregular surface. In addition, a horizontal drive member pivotally mounted to a base of the golf bag in the Maeng reference must be sufficiently rigid and large to withstand the tilting force, because the drive member must provide all of the actuating force to the U-shaped actuating member.

Since golf entails periods of waiting and substantial amount of walking during the game, it is also desirable to provide a seat on the golf bag of sufficient strength to support the weight of a golfer. The seat should take up a minimal amount of space or be collapsible or removable so as not to impede the golfer in manually carrying the bag or installing on a golf cart.

SUMMARY OF THE INVENTION

Accordingly, the present invention is directed to a golf bag with a built-in seating device that substantially obviates one or more of the problems due to limitations and disadvantages of the related art.

It is an object of the present invention to provide a self-supporting golf bag having a seat of sufficient strength and dimension to support a golfer when seated thereon.

It is a further object of the present invention to provide a golf bag having a collapsible seat that may be collapsed close to the bag for easy transport.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a golf bag comprises a body having a front surface, a back surface, a lower region and a base member, the body defining a longitudinal axis; at least one leg pivotally connected to the back surface of the body pivoting between a retracted position where the leg is disposed substantially longitudinally along the back surface of the body and an extended position where the lower end of the leg is spaced apart from the body; a pocket member attached to the front lower region of the body, the pocket member having a collapsible seating surface associated with the front surface of the body; and a support structure connected to the base member and disposed in the pocket member. The support structure including at least one frame member supporting the seating surface, wherein ends of the frame member are coupled to the base member of the body to form the seating surface when the body is tilted.

According to one aspect of the present invention, the support member includes a first frame member connected to the base member and a second frame member pivotally connected to the base member. The second frame member is at least partially coupled to the body to pivot in accordance with the pivoting movement of the body. Preferably, the first frame member is unpivotally erected from the base member.

According to another aspect of the present invention, the base member has first and second receptacles. Each one of the first receptacles defines an opening having a longitudinal cross-section substantially identical to that of the first frame member to securely couple the first frame member with respect to the base member. The ends of the second frame member are substantially spherical and each one of the second receptacles has a socket for receiving the ends of the second frame member to form a pivoting connection.

According to a second embodiment of the present invention, the support member includes a first frame bar connected to the base member and a second frame member pivotally connected to the base member. Preferably, the second frame member of the support member is at least partially coupled to the body to pivot in accordance with the pivoting movement of the body. The first frame bar is unpivotally erected from the base member.

According to one aspect of the second embodiment of the present invention, the base member has first and second receptacles. The first receptacle defines an opening having a longitudinal cross-section substantially identical with that of the first frame bar to securely couple the first frame bar to the base member. The ends of the second frame member are substantially spherical and each one of the second receptacles has a socket for receiving the ends of the second frame member to form a pivoting connection.

These and other aspects, features and advantages of the present invention will be better understood by studying the detailed description in conjunction with the drawings and the accompanying claims.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

With reference to the drawings, and in particular to FIGS. 1–10 thereof, a golf bag with a seating apparatus or member embodying the principles and concepts of the present invention will be described.

Figures 1, 2:
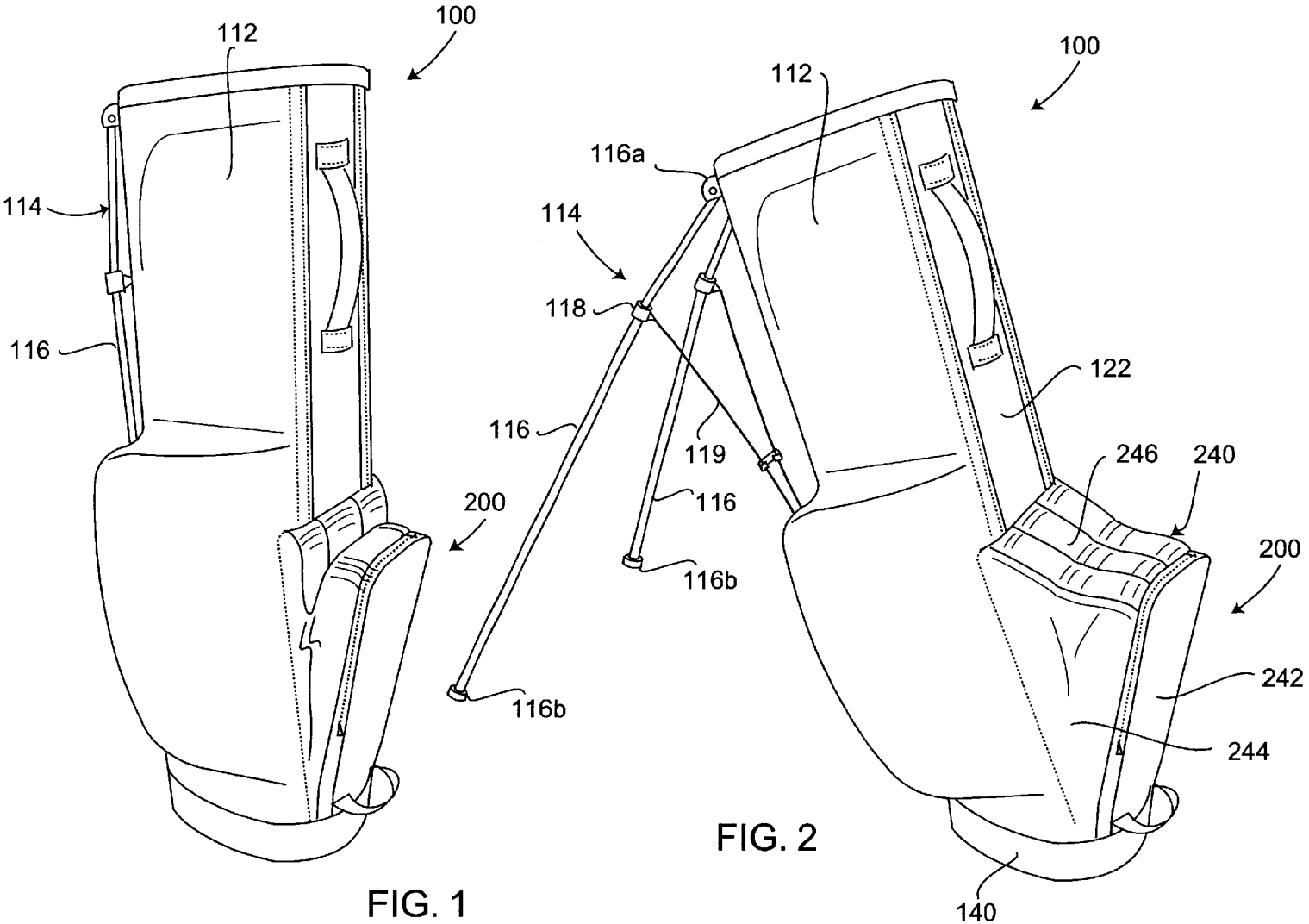
FIG. 1 Illustrates a perspective view of a first embodiment of the present invention with support legs and a seating member in a retracted position.
FIG. 2 Illustrates a perspective view of the first embodiment shown in FIG. 1 with the support legs and the seating member in an extended position.
Figures 3, 4, 5, 6:
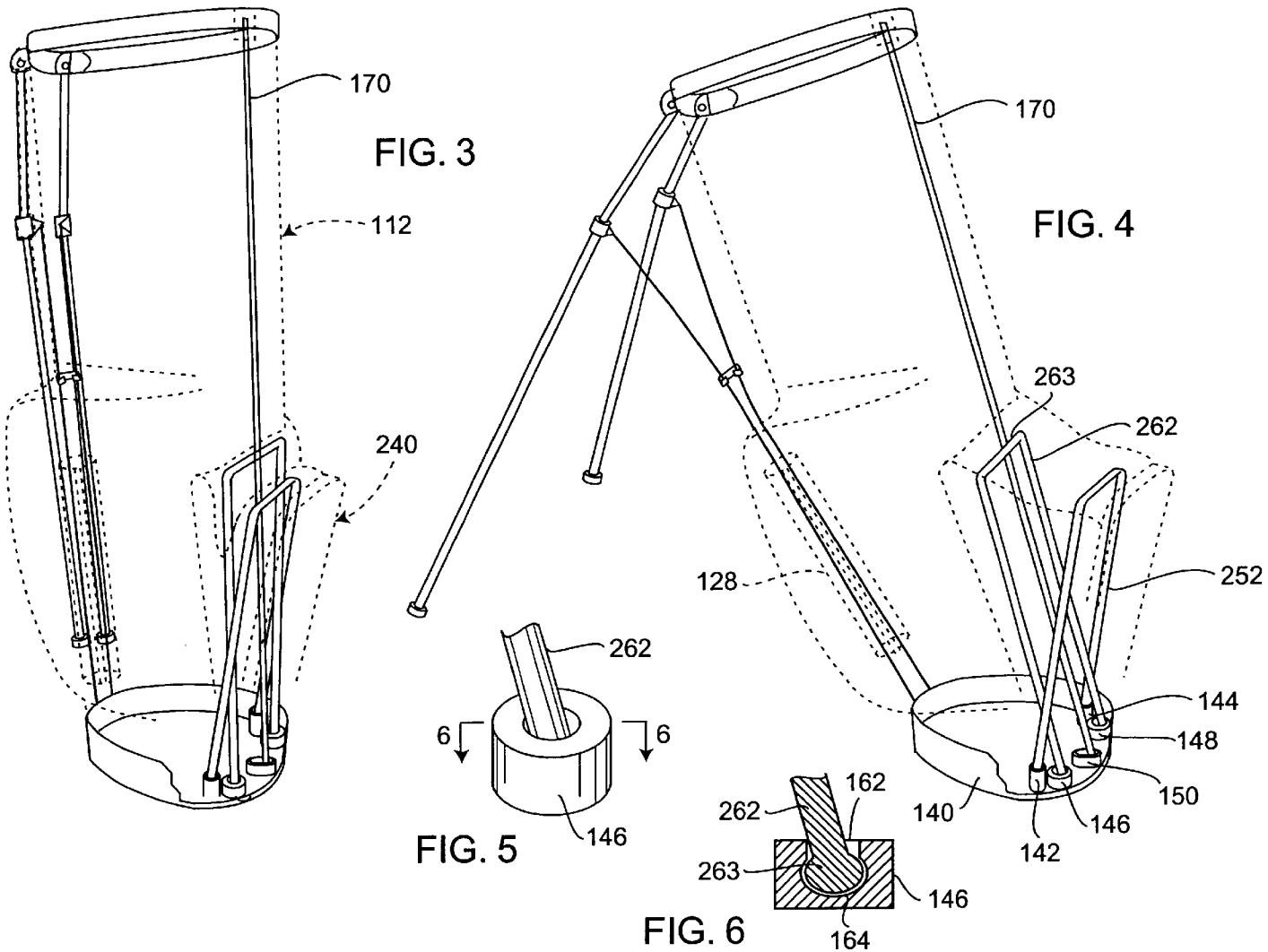
FIG. 3 illustrates a schematic view of the first embodiment showing the inner components of the seating member and the support legs.
FIG. 4 illustrates a schematic view of the first embodiment of FIG. 2 showing the inner components of the seating member and the support legs.
FIG. 5 Illustrates a perspective view of a receptacle used to pivot a support structure of the seating member according to the present invention.
FIG. 6 Illustrates a cross-sectional view of the receptacle shown in FIG. 5 along line 6—6.

A golf bag with a support stand 114 and a seat member 200 according to embodiments of the present invention is shown in the drawings for purposes of illustration. Referring to FIGS. 15, there is shown a golf bag 100 of a first embodiment having a bag body 112, a support stand assembly 114 and a seat member 200. The bag body 112 is preferably tubular in shape and has an opening at the top, as best seen in FIG. 3. The bottom of the bag is closed by a rigid base member 140. The rigid base member 140 as best seen in FIG. 2 forms part of a seat member 200 by supporting the support structure that forms the seat member 200. The base member 140 is coupled to the lower portions of the bag body 112 and preferably has a shape similar to a lateral cross-section of the bag body 112.

First, the support stand assembly 114 will be described. The support stand assembly 114 is well known to one of ordinary skill in the art and generally includes two support legs 116, the upper ends 116*a*, of which are pivotally attached to an attachment assembly, which is in turn fixed to the bag body 112, preferably near the opening of the bag body 112. The bottom ends of the legs 116*b* rest on a surface when the bag is in an extended position as shown in FIG. 2. In preferred embodiments, each of the legs 116, has a tubular coupling member 118 mounted on a middle portion of each leg 116. A linking member 119, such as flexible rod is pivotally connected to each tubular member 118 at first end. The second end of each linking member 119 is slidably held against the bag body 112 and is coupled to the rear end of the base member 140.

In the embodiment of FIG. 4, the linking members 119 are held by an elongated support pocket 128. The legs 116 may pivot between a retracted position and an extended position as shown in FIGS. 1 and 2.

In the retracted position, as shown in FIG. 1, the legs 116 rests along the bag body 112 near an outer rear surface thereof. In the extended position, as shown in FIG. 2, the legs 116 are positioned at an angle, preferably between about 20–50 degrees, with respect to a longitudinal axis of the bag body 112, and the lower ends 116*b* of the legs are spaced apart from the bag body 112. When in the extended position, the lower ends 116*b* of the legs and the base member 140 of the golf bag 100 may contact a supporting surface, such as the ground, so that the golf bag stands on the ground in a self-supported and leaning manner.

The pivoting of the legs 116 between the retracted and extended positions is actuated by pushing downward on the bag preferably at a region toward the rear side of the bag body 112 to where the support stand assembly 114 is attached. When pushed downward or tilted rearward, the linking members 119 are caused to flex and pivot away from the bag body 112 thereby moving the tubular coupling members 118 away from the bag body 112. Thus, the legs 116 are caused to pivot to their extended position. The legs 116 may also be grasped and pulled away from the bag body to their extended position.

It will be recognized that other forms of support stands will also function to support the golf bag at an angle when the seat is in use. Moreover, the bag body 112 is made of flexible but resilient material to allow pivoting of the bag while allowing the base member 140 to be placed flush against the support surface.

FIGS. 1–6 illustrate the first embodiment of the present invention. In particular, FIG. 1 illustrates a perspective view of the first embodiment of the present invention with support legs 116 and the seating member in a retracted position. FIG. 2 illustrates a perspective view of the first embodiment of FIG. 1 with the support legs and the seating member in an extended position. The golf bag 100 according to the first embodiment of the present invention includes a built-in extendable and retractable seating member 200. Preferably, the seating member 200 is in a retracted position when the golf bag 100 is in an upright position with its supports legs 116 retracted along the length of the bag body 112. The seating member 200 is in an extended position when the golfbag 100 is in an angled position with its support legs 116 extended away from the bag body 112.

FIG. 3 illustrates a schematic view of the first embodiment showing the inner components of the seating member 200 and the support legs 116. FIG. 4 illustrates a schematic view of the first embodiment shown in FIG. 2 with the inner components of the seating member 200 shown in solid lines. According to the first embodiment of the present invention, the seating member 200 may include a housing or pocket member 240, which is preferably affixed to the outer wall or frame of the bag body 112, and a support structure comprising inverse U-shaped first and second frame members 252 and 262. The housing member 240 is preferably stitched onto the bag body 112. Other alternative methods of securing the housing member 240 to the bag body 112 known to one of ordinary skill in the art may also be implemented.

The housing member 240 comprises a front wall 242, side walls 244 and a top wall which serves as a seating surface 246, all of which are joined with respect to each other to define a cavity for placing the support structure. In particular, the front wall 242 is partially releasably attached to the side walls 244 and the seating surface 246 using a zipper or other fastners. As a result, the cavity defined by the housing member 240 may also be used for storing golf equipment, such as balls and shoes, etc. The lower ends of the housing member 240 and the bag body 112 are securely attached, preferably stitched, to an opening defined by the base member 140.

In the first embodiment, the housing member 240 is made with the same type of flexible and sturdy material used for making the bag body 112. Such material is well known to one of ordinary skill in the art and is typically made of a sturdy and durable water-resistant fabric. To provide comfort, the seating surface 246 may be padded or layered. The first and second frame members 252 and 262 are preferably made with steel, aluminum or plastic bars to provide sufficient support against the weight of a golfer.

Referring to FIGS. 2 and 4, when the bag body 112 is tilted toward the rear of the golf bag 100, the seating surface 246, which is associated with the front surface 122 of the lower region of the bag body 112, is stretched out, thus, providing a substantially planar surface adaptable for seating. When extended, the seating surface 246 lies substantially parallel to the base member 140 of the golf bag 100 which typically is placed flush against a playing surface, such as ground. The seating surface 246 can also assume a substantially collapsed or retracted position as shown in FIGS. 1 and 3 where it is collapsed against the front surface 122 of the lower region of the bag.

The golf bag 100 according to the present invention also includes a spine member 170 extending substantially along the elongated length of the bag body 112. The spine member 170 provides a form and shape to the golf bag 100. Although only one spine member 170 is shown in FIGS. 3 and 4 for purpose of illustration, there may be one or more vertical spine members disposed around the elongated length of the bag body. In the preferred embodiment, one end of the spine member 170 is secured to the top rim of the bag body 112, while the opposite end is coupled or pivotally attached to the base member 140. As a result, when the golf bag 100 is tilted toward its rear region, the spine region (the front side of the bag body) is substantially straight due to the presence of the spine member 170. This allows the base member 140 of the golf bag 100 to be placed flush against the ground providing stability to the golf bag 100. As an alternative embodiment, the spine member 170 may be placed along the inner surface of the rear wall of the bag body 112 in lieu of the inner front wall as shown in FIG. 4. The spine member 170 is preferably made with a lightweight and rigid material, such as aluminum or steel rod.

Referring to FIGS. 3 and 4, the base member 140 of the golf bag 100 has a plurality of receptacles or sockets for receiving the first and second frame member 252 and 262 and the spine member 170. The receptacles 142, 144, 146, 148 and 150 are formed with the base member 140, preferably using an injection molding process.

The base member 140 has first receptacles 142 and 144 for receiving therein leg portions of the first frame member 252. The first receptacles 142 and 144 are identical in shape and are configured to receive the ends of the legs of the first frame member 252. The longitudinal cross-section of the each receptacle 142 and 144 is substantially the same as the cross-section of the legs of the first frame member 252 for a snug fit. As a result, the first frame member 252 does not pivot with respect to the base member 140, and therefore, is erected substantially upright.

Referring to FIGS. 5 and 6, there are also second receptacles 146 and 148 provided in the base member 140. The second receptacles 146 and 148 are identical in shape and are configured to receive the ends of the legs of the second frame member 262. As shown in FIG. 5, the opening 162 of the each receptacle 142 and 144 is larger than the diameter of the leg of the second frame member 262. Preferably, the opening defined by the second receptacles 146 and 148 are elliptical to allow the second frame member 262 to pivot from rear to front and vice versa as the bag body 112 is tilted with respect to the base member 140.

FIG. 6 illustrates a cross-sectional view of the socket shown in FIG. 5 along line 6—6. Referring to FIG. 6, the second receptacle 146 has a ball-shaped socket 164 for receiving the end portion of the second frame member 262, which also has correspondingly shaped ends 263. As a result, the second frame member 262 may be pushed into and engaged in the receptacle 146 by using a slight force. Once the sphere shaped ends 263 of the second frame member 262 is inserted into the socket 164 of the second receptacle 146, the leg portion of the second frame member 262 pivots, thereby causing the seating member 200 to extend or collapse depending on the tilting angle of the bag body 112.

In an alternative configuration, the first frame member 252 may also be pivotally attached to the base member 140 using the substantially similar receptacles as shown in FIGS. 5 and 6. In such embodiment, the first frame member 252 and the second frame member 262 can be pivoted independently to each other to allow the seating member 240 to be extended only when the golfer desires, and not when the golf bag is tilted.

As shown in FIG. 4, the base member 140 also has a spine receptacle 150 for receiving the lower end of the spine member 170. The spine receptacle 150 is substantially identical in construction as that of the second receptacle 146, and thus, its description will not be repeated here. In the preferred embodiment, the spine member 170 is positioned adjacent to the second frame member 262. As a result, as the spine member 170 is moved in an upright position, the spine member 170 pushes the horizontal or cross bar 263 of the second frame member 262 toward the front of the bag body 112 thus causing the first and second frame members 252 and 262 to collapse with respect to each other, as shown in FIG. 3.

Alternative to using the second receptacles 146, 148 and the spine receptacle 150 which allow pivoting of the second frame member 262 and the spine member 170, respectively, the second frame member 262 may be coupled to the front region of the base member 140 by using a bolt and nut assembly or other suitable pivoting mechanism known to one of ordinary skill in the art. The same is also true for the spine receptacle 150.

In the above description, the first embodiment of the present invention has the support structure, comprising the first and second frame members 252 and 262, which is located inside the housing member 240. However, the housing member 240 is merely an aesthetic cover and therefore, such housing member 240 may be eliminated entirely to expose the frames. In such embodiment, the horizontal or cross bars of the first and second frame member 252 and 262 may be coupled to each other by a fabric or leather piece, a mesh-like material or other suitable material known to one of ordinary skill in the art to provide a seating surface.

Furthermore, to strengthen the weight support of the first and second frame member 252 and 262, there may be a third frame member which can be pivotally attached to the base member 140 in a similar fashion as the second frame member 262. The third frame member, in addition to the first and second frame members, can sustain the weight of a heavier golfer.

Figures 7, 8:
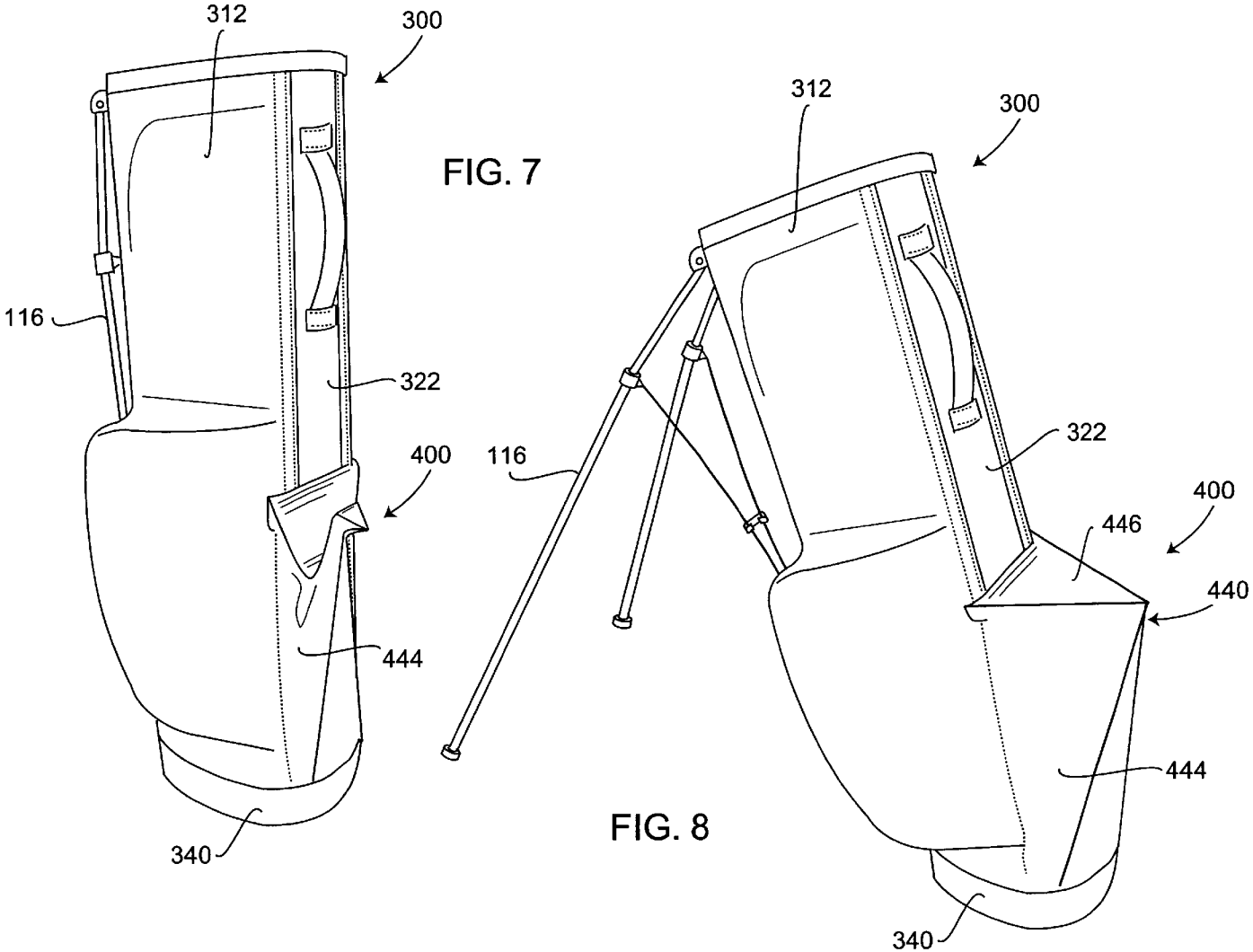
FIG. 7 Illustrates a perspective view of a second embodiment of the present invention with support legs and seating member in a retracted position.
FIG. 8 Illustrates a perspective view of the second embodiment shown in FIG. 7 with the support legs and the seating member in an extended position.

FIGS. 7–10 illustrate a second embodiment of the present invention. In particular, FIG. 7 illustrates a perspective view of the second embodiment of the present invention with support legs 116 and the seating member in a retracted position. FIG. 8 illustrates a perspective view of the second embodiment of FIG. 7 with the support legs 116 and the seating member 400 in an extended position. The golf bag 300 according to the second embodiment of the present invention includes a built-in extendable and retractable seating member 400. Preferably, the seating member 400 is in a retracted position when the golf bag 300 is in an upright position with its supports legs 116 retracted along the length of the bag body 312. The seating member 400 is in an extended position when the golf bag 300 is in an angled position with its support legs 116 extended away from the bag body 312.

Figure 10:
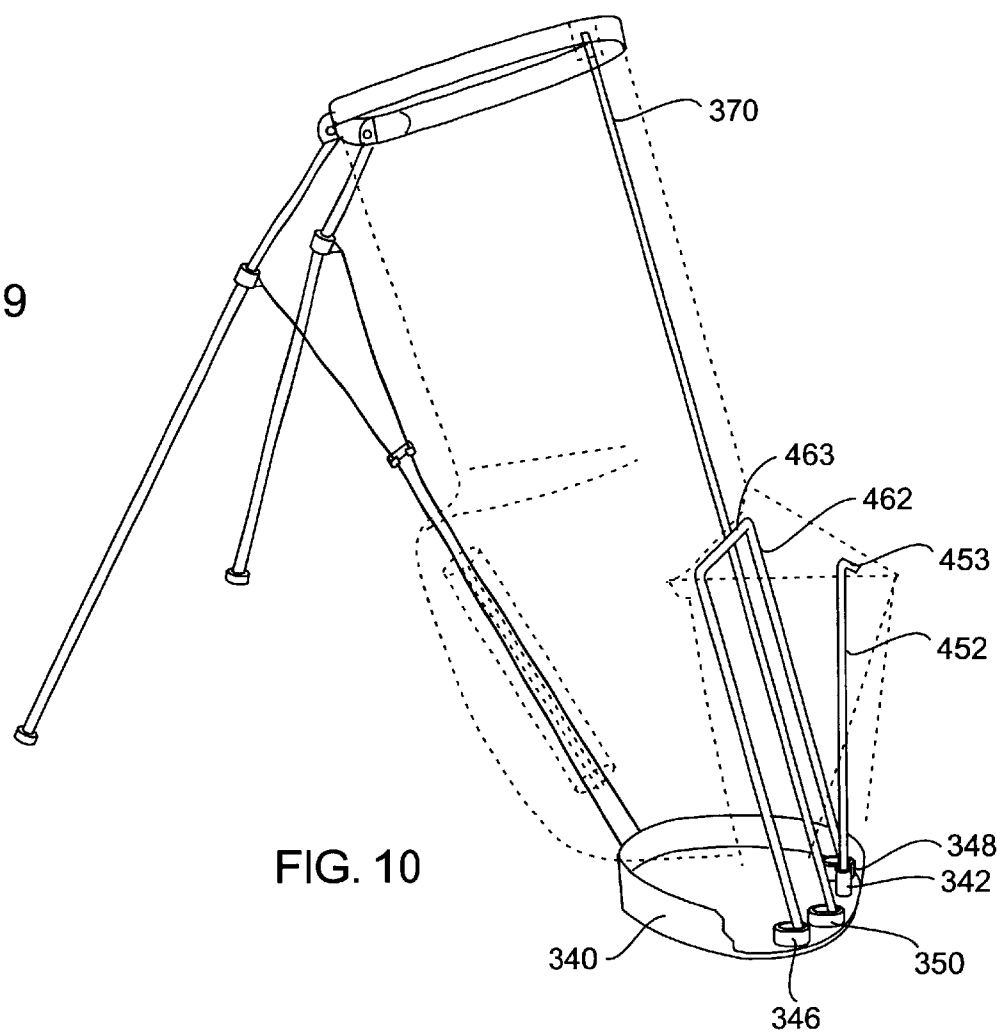
FIG. 10 Illustrates a schematic view of the second embodiment of FIG. 8 showing the inner components of the seating member and the support legs.
Figure 9:
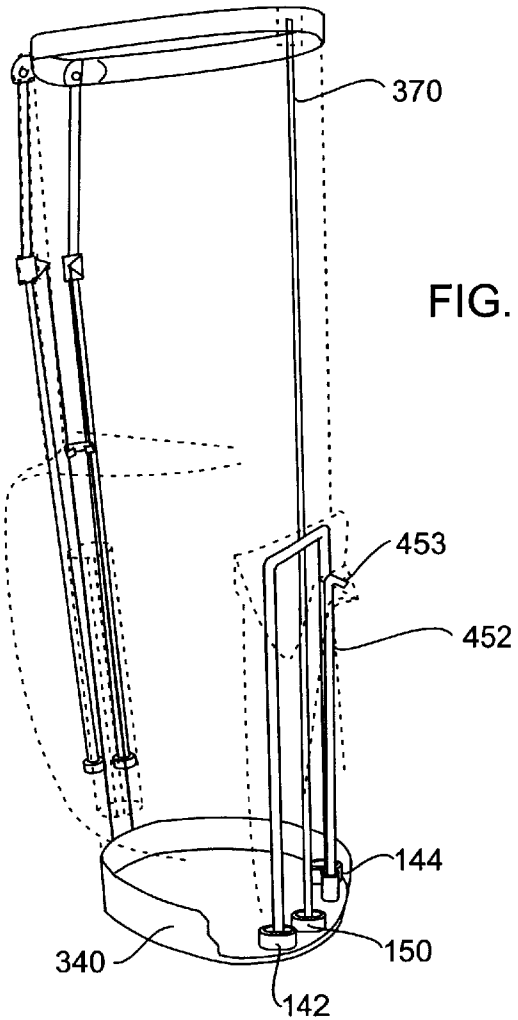
FIG. 9 Illustrates a schematic view of the second embodiment shown in FIG. 7 showing the inner components of the seating member and the support legs.

FIG. 9 illustrates a schematic view of the second embodiment showing the inner components of the seating member 400 and the support legs 116. FIG. 10 illustrates a schematic view of the second embodiment shown in FIG. 8 with the inner components of the seating member 200 shown in solid lines. According to the second embodiment of the present invention, the seating member 400 includes a housing member 440, which is preferably affixed to the outer wall or frame of the bag body 312, and a support structure comprising a vertical first frame bar 452 and an inverse U-shaped second frame member 462. The housing member 440 is preferably stitched onto the bag body 312. Other alternative methods of securing the housing member 440 to the bag body 312 known to one of ordinary skill in the art may also be implemented.

The housing member 440 comprises side walls 244 and a top wall which serves as a seating surface 446, all of which are joined with respect to each other to define a cavity for placing the support structure. In particular, one of the side walls 444 is releasably attached to the other side wall 244 and the seating surface 446 using a zipper or other fasteners. As a result, the cavity defined by the housing member 440 may also be used for storing golf equipment. The lower ends of the housing member 440 and the bag body 312 are securely attached, preferably stitched, to an opening defined by the base member 340.

Similar to the first embodiment of the present invention, the housing member 440 of the second embodiment is made with the same type of flexible and sturdy material used for making the bag body 312. Such material is well known to one of ordinary skill in the art and is typically made of a sturdy and durable water-resistant fabric. To provide comfort, the seating surface 446 may be padded or layered. The first frame bar 452 and the second frame member 462 are preferably made with steel, aluminum or plastic bars to provide sufficient support against the weight of a golfer.

In the second embodiment, the lower end of the first frame bar 452 is attached to the base member 340 through the first receptacle 342. The top end 453 of the first frame bar 452 is preferably bent to from an L-shape. Such bent top end 453 is securely coupled to the end region of the seating surface 446.

Referring to FIGS. 8 and 10, when the bag body 312 is tilted toward the rear of the golf bag 300, the seating surface 446, which is associated with the front surface 322 of the lower region of the bag body 312, is stretched out, thus, providing a substantially planar surface adaptable for seating. When extended, the seating surface 446 lies substantially parallel to the base member 340 of the golf bag 300 which typically is placed flush against a playing surface, such as ground. The seating surface 446 can also assume a substantially collapsed or retracted position as shown in FIGS. 7 and 9 where it is collapsed against the front surface 322 of the lower region of the bag.

Similar to the first embodiment, the golf bag 300 according to the second embodiment also includes a spine member 370 extending substantially along the elongated length of the bag body 312. The spine member 370 provides a form and shape to the golf bag 300. Although only one spine member 370 is shown in FIGS. 9 and 10 for purpose of illustration, there may be one or more vertical spine members disposed around the elongated length of the bag body. In the preferred embodiment, one end of the spine member 370 is secured to the top rim of the bag body 312, while the opposite end is pivotally attached to the base member 340. As a result, when the golf bag 300 is tilted toward its rear region, the spine region (the front side of the bag body) is substantially straight due to the presence of the spine member 370. This allows the base member 340 of the golf bag 300 to be placed flush against the ground providing stability to the golf bag 300. As an alternative embodiment, the spine member 370 may be placed along the inner surface of the rear wall of the bag body 312 in lieu of the inner front wall as shown in FIG. 10. The spine member 370 is preferably made with a lightweight and rigid material, such as aluminum or steel rod.

Referring to FIGS. 9 and 10, the base member 340 of the golf bag 100 has a plurality of receptacles or sockets for receiving the first frame bar 452 and the second frame member 462 and the spine member 370. The receptacles 342, 346, 348 and 350 are formed with the base member 340, preferably using an injection molding process.

The base member 340 has a first receptacle 342 for receiving therein one end of the first frame bar 452. The diameter or the circumference defining the opening of the first receptacle 342 is substantially the same as that of the first frame bar 452 for a snug fit. As a result, the first frame bar 452 does not pivot with respect to the base member 340, and therefore, is erected substantially upright.

The construction of the second receptacles 346 and 348 in the base member 340 are identical to that of the first embodiment shown in FIGS. 5 and 6 and their description is incorporated herein by reference. The second receptacles 346 and 348 are identical in shape and are configured to receive the ends of the legs of the second frame member 462.

In an alternative configuration, the first frame bar 452 may also be pivotally attached to the base member 340 using the substantially similar receptacles as shown in FIGS. 5 and 6. In such embodiment, the first frame bar 452 and the second frame member 462 can be pivoted independently to each other to allow the seating member 440 to be extended only when the golfer desires, and not when the golf bag 300 is tilted.

As shown in FIG. 10, the base member 340 also has a spine receptacle 350 for receiving the lower end of the spine member 370. The spine receptacle 350 is substantially identical in construction as that of the second receptacle 346, and thus, its description is incorporated herein by reference. In the preferred embodiment, the spine member 370 is positioned adjacent to the second frame member 462. As a result, as the spine member 370 is moved in an upright position, the spine member 370 pushes the horizontal or cross bar 463 of the second frame member 462 toward the front of the bag body 312 thus causing the first frame bar 452 and the second frame member 462 to collapse with respect to each other, as shown in FIG. 9.

Alternative to using the second receptacles 346, 348 and the spine receptacle 350 which allow pivoting of the second frame member 462 and the spine member 370, respectively, the second frame member 462 may be coupled to the front region of the base member 340 by using a bolt and nut assembly or other suitable pivoting mechanism known to one of ordinary skill in the art. The same is also true for the spine receptacle 350.

In the above description, the second embodiment of the present invention has the support structure, comprising the first frame bar 452 and the second frame member 462, which is located inside the housing member 440. However, the housing member 440 is merely an aesthetic cover and therefore, such housing member 440 may be eliminated entirely to expose the frames. In such embodiment, the horizontal or cross bar of the second frame member 462 and the first frame bar 452 may be coupled to each other by a fabric or leather piece, a mesh-like material or other suitable material known to one of ordinary skill in the art to provide a seating surface.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A golf bag comprising:

a body having a front surface, a back surface, a lower region and a base member, the body defining a longitudinal axis; and a seat member coupled to the lower region of the front surface of the bag body, the seat member comprising:

a seating surface extending from the front surface of the lower region of the bag, wherein the seating surface having first and second ends, the first end connected to the front surface of the bag; and a support member comprising at least one frame member supporting and connected to the second end of the seating surface, wherein ends of the frame member are extended from the base member of the body to form the seating surface when the body is tilted.

2. The golf bag of claim 1, further comprising at least one leg pivotally connected to the back surface of the body pivoting between a retracted position where the leg is disposed substantially longitudinally along the back surface of the body and an extended position where lower end of the leg is spaced apart from the body.

3. The golf bag of claim 1, wherein the support member includes a first frame member connected to the base member and a second frame member pivotally connected to the base member.

4. The golf bag of claim 3, wherein the second frame member is at least partially coupled to the body to pivot in accordance with the pivoting movement of the body.

5. The golf bag of claim 3, wherein the first frame member is unpivotally erected from the base member.

6. The golf bag of claim 3, wherein the base member has first and second receptacles, wherein each one of the first receptacles defines an opening having a longitudinal cross-section substantially identical with that of the first frame member to securely couple the first frame member with respect to the base member.

7. The golf bag of claim 6, wherein the ends of the second frame member are substantially spherical and each one of the second receptacles has a socket for receiving the ends of the second frame member to form a pivoting connection.

8. The golf bag of claim 7, wherein the base member has first and second receptacles, wherein the first receptacle defines an opening having a longitudinal cross-section substantially identical with that of the first frame bar to securely couple the first frame bar to the base member.

9. The golf bag of claim 8, wherein the ends of the second frame member are substantially spherical and each one of the second receptacles has a socket for receiving the ends of the second frame member to form a pivoting connection.

10. The golf bag of claim 9, wherein the frame member is pivotally coupled to the base member.

11. The golf bag of claim 9, wherein the support member includes a first frame bar connected to the base member and a second frame member pivotally connected to the base member.

12. The golf bag of claim 11, wherein the second frame member is at least partially coupled to the body to pivot in accordance with the pivoting movement of the body.

13. The golf bag of claim 11, wherein the first frame bar is unpivotally erected from the base member.

14. The golf bag of claim 1, wherein the frame member is pivotally coupled to the base member.

15. The golf bag of claim 1, wherein the support member includes a first frame bar connected to the base member and a second frame member pivotally connected to the base member.

16. The golf bag of claim 15, wherein the second frame member is at least partially coupled to the body to pivot in accordance with the pivoting movement of the body.

17. The golf bag of claim 15, wherein the first frame bar is unpivotally erected from the base member.

18. A golf bag comprising:

a body having a front surface, a back surface, a lower region and a base member, the body defining a longitudinal axis;

at least one leg pivotally connected to the back surface of the body pivoting between a retracted position where the leg is disposed substantially longitudinally along the back surface of the body and an extended position where lower end of the leg is spaced apart from the body;

a pocket member attached to the front lower region of the body, the pocket member having a collapsible seating surface associated with the front surface of the body; and a support structure connected to the base member and disposed in the pocket member, the support structure including at least one frame member supporting the seating surface, wherein ends of the frame member are extended from the base member of the body to form the seating surface when the body is tilted.

19. The golf bag of claim 18, wherein the support member includes a first frame member connected to the base member and a second frame member pivotally connected to the base member.

20. The golf bag of claim 19, wherein the second frame member is at least partially coupled to the body to pivot in accordance with the pivoting movement of the body.

21. The golf bag of claim 19, wherein the first frame member is unpivotally erected from the base member.

22. The golf bag of claim 19, wherein the base member has first and second receptacles, wherein each one of the first receptacles defines an opening having a longitudinal cross-section substantially identical with that of the first frame member to securely couple the first frame member with respect to the base member.

23. The golf bag of claim 22, wherein the ends of the second frame member are substantially spherical and each one of the second receptacles has a socket for receiving the ends of the second frame member to form a pivoting connection.

24. The golf bag of claim 23, wherein the base member has first and second receptacles, wherein the first receptacle defines an opening having a longitudinal cross-section substantially identical with that of the first frame bar to securely couple the first frame bar to the base member.

25. The golf bag of claim 24, wherein the ends of the second frame member are substantially spherical and each one of the second receptacles has a socket for receiving the ends of the second frame member to form a pivoting connection.

26. A golf bag comprising:

a body having a front surface, a back surface, a lower region and a base member; and a seat member coupled to the lower region of the front surface of the body, the seat member comprising:

a seating surface extending from the front surface of the lower region of the body; and a support member comprising a first frame member connected to the base member and a second frame member pivotally connected to the base member, wherein the first frame member is unpivotally erected from the base member and supports the seating surface.

27. A golf bag comprising:

a body having a front surface, a back surface, a lower region and a base member;

a pocket member attached to the front lower region of the body, the pocket member having a collapsible seating surface associated with the front surface of the body; and a support structure connected to the base member and disposed in the pocket member, the support structure including at least one frame member supporting the seating surface, wherein ends of the frame member are extended from the base member of the body to form the seating surface when the body is tilted.

28. A golf bag comprising:

a body having a front surface, a back surface, a lower region and a base member;

a pocket member attached to the front lower region of the body, the pocket member having a collapsible seating surface associated with the front surface of the body; and a support structure disposed in the pocket member, the support structure including at least one frame member supporting the seating surface, wherein the frame member is pivotally coupled to the lower region of the body to form the seating surface when the frame member is pivoted away from the front surface of the body.

* * * * *